US007275406B2

(12) United States Patent
Yogo

(10) Patent No.: US 7,275,406 B2
(45) Date of Patent: Oct. 2, 2007

(54) BENDING DEVICE

(75) Inventor: Teruaki Yogo, Seto (JP)

(73) Assignee: Kabushiki Kaisha Opton, Seto-shi, Aichi (JP)

( * ) Notice: Subject to any disclaimer, the term of this patent is extended or adjusted under 35 U.S.C. 154(b) by 57 days.

(21) Appl. No.: 11/235,695

(22) Filed: Sep. 26, 2005

(65) Prior Publication Data

US 2006/0065034 A1 Mar. 30, 2006

(30) Foreign Application Priority Data

Sep. 27, 2004 (JP) ..... 2004-279592

(51) Int. Cl.
*B21D 7/02* (2006.01)

(52) U.S. Cl. ..... 72/306

(58) Field of Classification Search ..... 72/306, 72/307, 149, 157

See application file for complete search history.

(56) References Cited

U.S. PATENT DOCUMENTS 4,739,643 A * 4/1988 Kuriyama et al. ..... 72/306
4,945,747 A * 8/1990 Yogo ..... 72/306
5,291,771 A * 3/1994 Tomo et al. ..... 72/306
6,237,380 B1 * 5/2001 Kanamori ..... 72/14.8

FOREIGN PATENT DOCUMENTS

JP 2001-212624 8/2001

* cited by examiner

*Primary Examiner*—Daniel C Crane
(74) *Attorney, Agent, or Firm*—Davis Bujold & Daniels, P.L.L.C.

(57) ABSTRACT

A bending device includes a fixed mount having a chuck mechanism gripping a workpiece is attached thereon, and an articulated robot which moves a bending mechanism attached thereto. The articulated robot is provided with a plurality of swinging joints which perform swinging operation and a plurality of pivoting joints which perform pivoting operation. The workpiece is clamped between a bending die and a clamping die. The bending mechanism is moved by the articulated robot so that the workpiece is gripped by the chuck mechanism. At the same time, the chuck mechanism is moved by the articulated robot to bend the workpiece at a plurality of positions. After the bending, while the workpiece is clamped between the bending die and the claimping die, the gripping by the chuck mechanism is released. The bending mechanism is moved by the articulated robot so that the workpiece is discharged.

7 Claims, 12 Drawing Sheets

BENDING DEVICE

FIELD OF THE INVENTION

This invention relates to a bending device that moves a bending mechanism around a longitudinal workpiece, such as a pipe or a stick-like member, when bending the workpiece toward a predetermined direction.

BACKGROUND OF THE INVENTION

A conventional bending device is known to include an articulated robot which is provided with three joints. Each joint of the articulated robot is rotated around an axis parallel to an axial direction of a workpiece gripped by a chuck mechanism. A bending mechanism attached at the end of the articulated robot is moved to a predetermined position by rotation of each joint of the articulated robot. At the same time, the chuck mechanism is moved by a moving mechanism in the axial direction of the workpiece so that the workpiece is bent by the bending mechanism at a plurality of positions (see Unexamined Japanese Patent Publication No. 2001-212624).

However, in such a conventional bending device as above, the chuck mechanism is moved by the moving mechanism so as to move the workpiece in the axial direction. Therefore, the moving mechanism requires a relatively large space which is sufficient for the chuck mechanism, gripping the workpiece, to be moved a predetermined distance, thus enlarging the size and the installation space of the bending device.

SUMMARY OF THE INVENTION

One object of the present invention is to provide a bending device which is compact in size and requires only a small installation space.

To attain this and other objects, a bending device of the present invention includes a chuck mechanism that grips a longitudinal workpiece, a bending mechanism that clamps the workpiece with a bending die and a clamping die capable of moving around the bending die and that bends the workpiece by rotation of the clamping die, an articulated robot that is capable of pivoting and provided with the moving mechanism at the end, and a control unit that controls the movement of the articulated robot and moves the bending mechanism along the workpiece.

The chuck mechanism may be fixed so as not to be moved. Or, the chuck mechanism may be movable so as to get close to or move away from the articulated robot when the bending mechanism attached to the end of the articulated robot does not reach the target position on the workpiece only by the arm movement of the articulated robot.

The articulated robot may include a plurality of bend or swinging joints and roll or pivoting joints. Each of the swinging joints allows two members connected via the swinging joint to swing on the swinging joint. Each of the pivoting joints allows one member connected to the other member via the pivoting joint to pivot on the other member. The control unit may be provided with a bending controller that moves the bending mechanism by the articulated robot to perform bending to the workpiece at a plurality of positions. Moreover, the control unit may be provided with a delivery control unit that clamps the workpiece between the bending die and the clamping die, and moves the bending mechanism by the articulated robot so as to make the chuck mechanism grip the workpiece. Or, the control unit may be provided with a discharge control unit that makes the chuck mechanism release the workpiece, with the bending die and the clamping die still clamping the workpiece, after the bending, and moves the bending mechanism by the articulated robot so as to discharge the workpiece.

In the bending device of the present invention, the articulated robot capable of pivoting moves the moving mechanism. Therefore, the bending device can be compact and requires only a relatively small installation space.

BRIEF DESCRIPTION OF THE DRAWING FIGURES

The invention will now be described, by way of example, with reference to the accompanying drawings, in which.

BEST MODE TO CARRY OUT THE INVENTION

Figure 1:
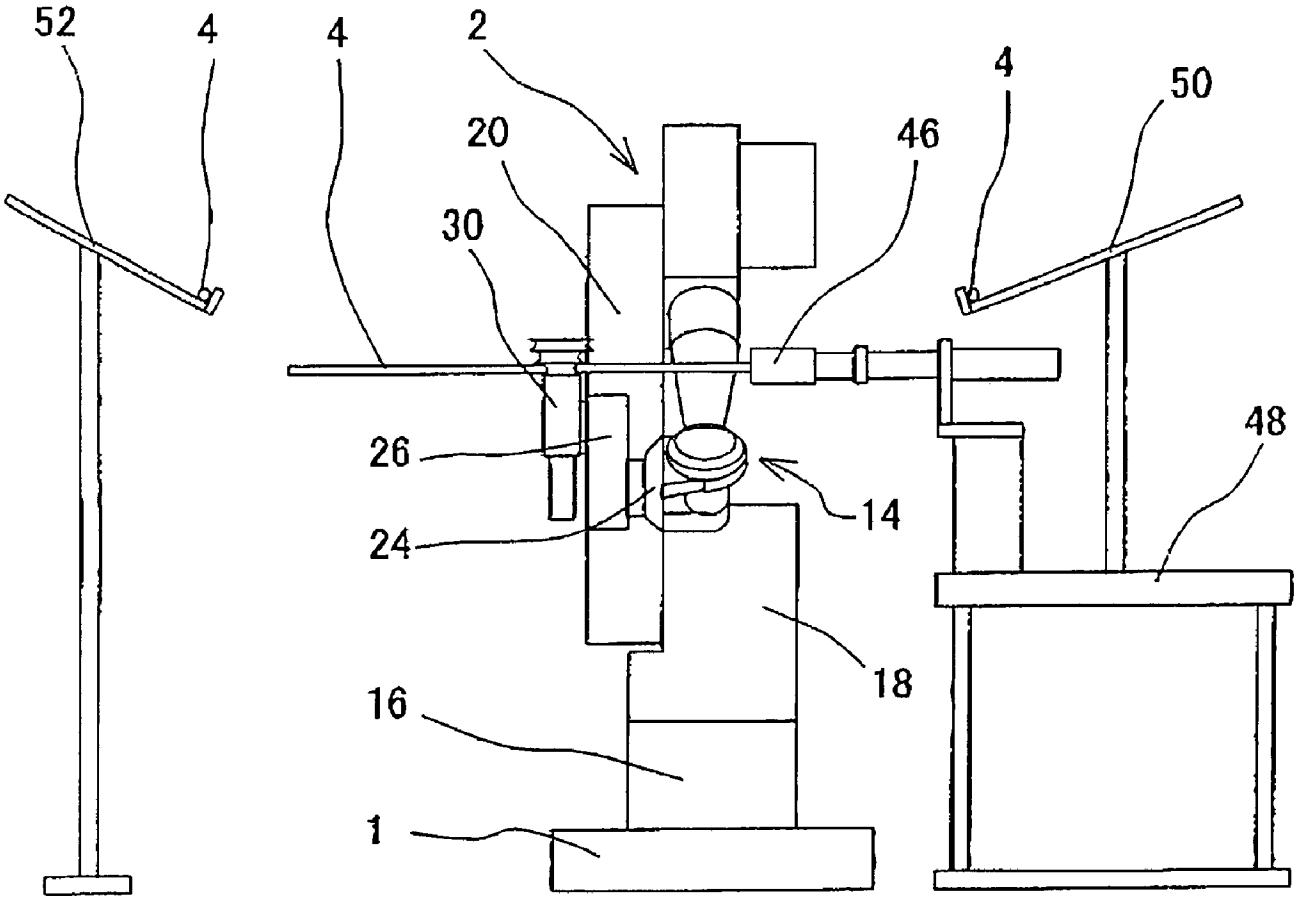
FIG. 1 is a front view of a bending device according to an embodiment of the present invention.
Figure 2:
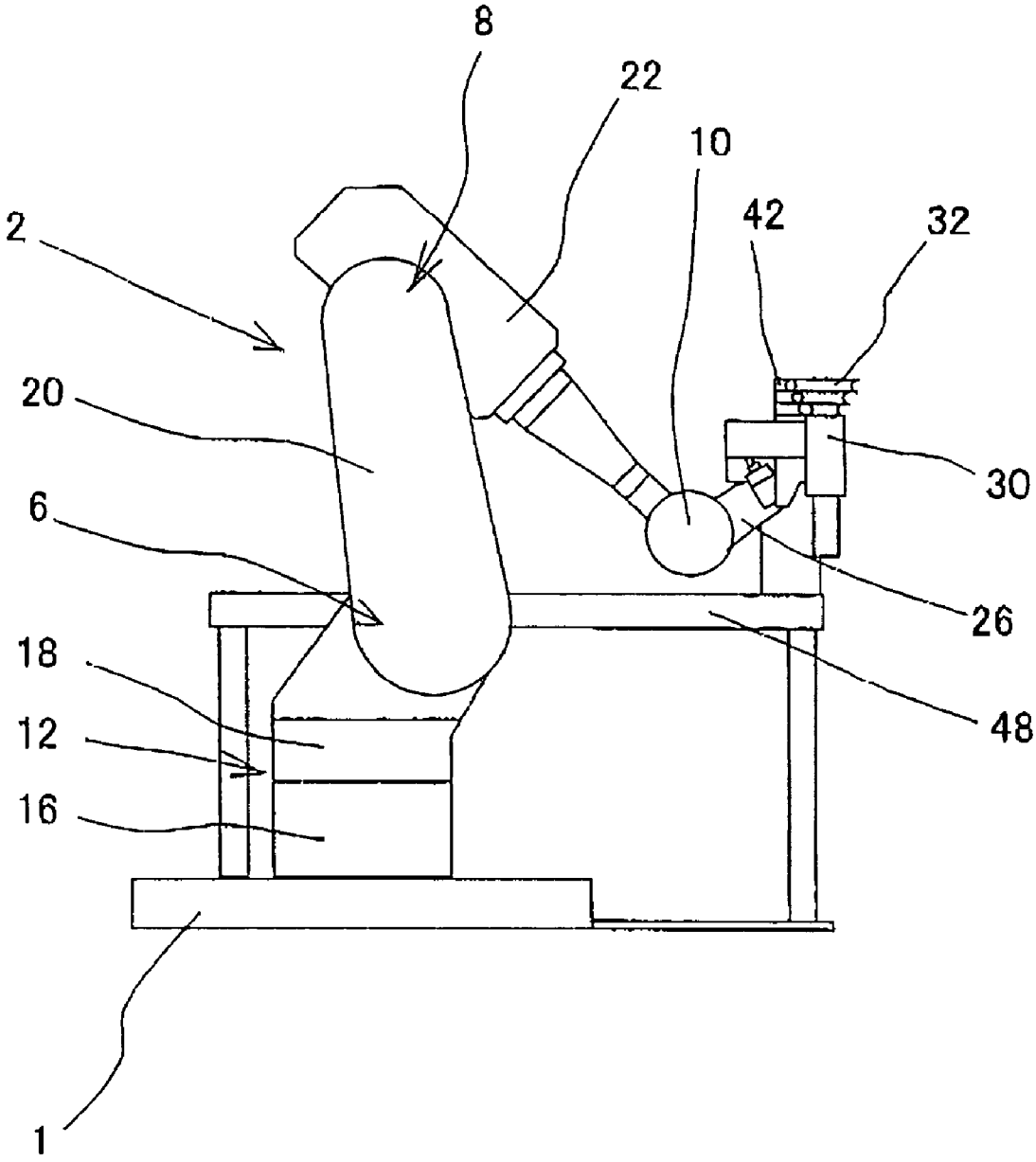
FIG. 2 is a left side view of the bending device according to the embodiment.

Referring to FIGS. 1 to 4, a bending device of the present embodiment is provided with a mount 1 and an articulated robot 2 disposed on the mount 1. A later-explained bending mechanism 30 that bends a longitudinal workpiece 4, such as a pipe, is attached to the end of the articulated robot 2. The articulated robot 2 is provided with three swinging joints, that is, a first swinging joint 6, a second swinging joint 8, and a third swinging joint 10, as well as three pivoting joints, that is, a first pivoting joint 12, a second pivoting joint 14, and a third pivoting joint 15. Each of the swinging joints 6, 8, and 10 allows two members connected via the swinging joint to swing on the swinging joint. Each of the pivoting joints 12, 14 and 15 allows one member connected to the other member via the pivoting joint to pivot on the other member. The axial direction of each swinging joint is orthogonal to a direction in which the swinging joint links two members together. The axial direction of each pivoting joint is the same with a direction in which the pivoting joint links two members together.

Figure 4:
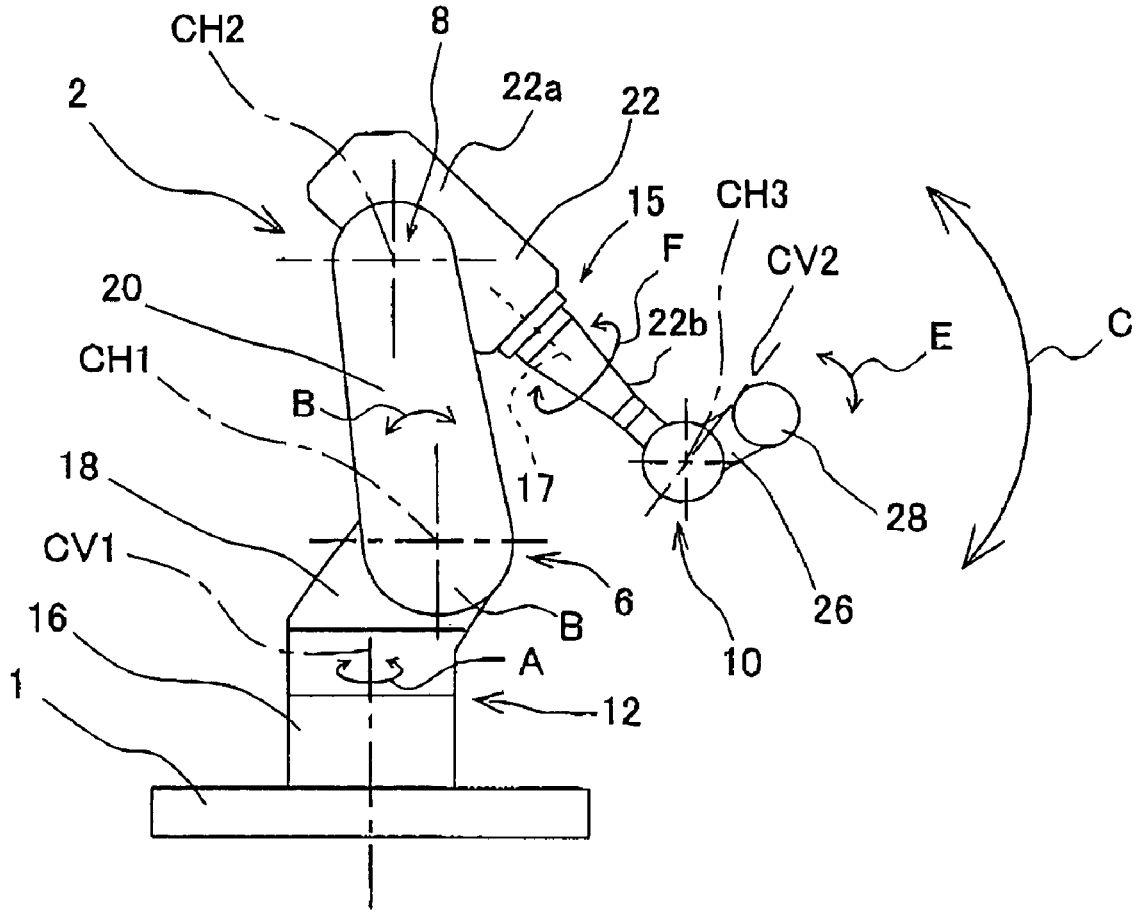
FIG. 4 is a left side view of an articulated robot according to the embodiment.

The articulated robot 2 is provided with a fixed base 16 attached to the mount 1. The fixed base 16 and a first rotational mount 18 are connected via the first pivoting joint 12. The first pivoting joint 12 is capable of rotating the first rotational mount 18 within a predetermined angle around a vertical axis CV1 (FIG. 4). FIG. 4 shows the rotational direction of the first rotational mount 18 by an arrow A.

One end of a first arm 20 is connected to the first rotational mount 18 via the first swinging joint 6. The first swinging joint 6 is capable of rotating the first arm 20 within a predetermined angle around a horizontal axis CH1 (FIG. 4). The horizontal axis CH1 of the first swinging joint 6 is orthogonal to the vertical axis CV1 of the first pivoting joint 12. FIG. 4 shows the rotational direction of the first arm 20 by an arrow B.

The other end of the first arm 20 and one end of a second arm 22 are connected via the second swinging joint 8. The second swinging joint 8 is capable of rotating the second arm 22 within a predetermined angle around an axis CH2 (FIG. 4) that is parallel to the horizontal axis CH1 of the first swinging joint 6. FIG. 4 shows the rotational direction of the second arm 22 by an arrow C.

Figure 3:
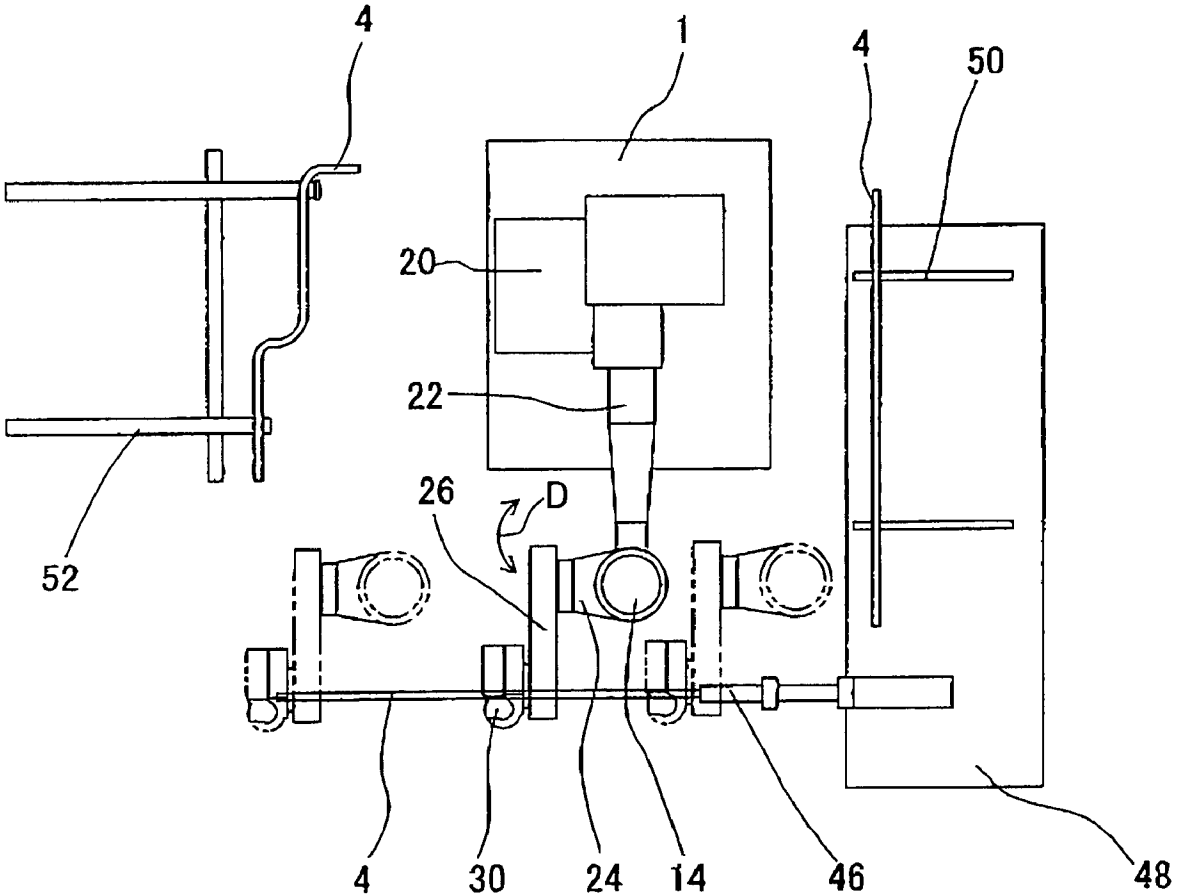
FIG. 3 is a plan view of the bending device according to the embodiment.

The other end of the second arm 22 is connected to a second rotational mount 24 (FIG. 3) via the second pivoting joint 14. The second pivoting joint 14 is capable of rotating the second rotational mount 24 within a predetermined angle around an axis CV2 (FIG. 4) that is orthogonal to the parallel axes CH1 and CH2. FIG. 3 shows the rotational direction of the second rotational mount 24 by an arrow D. One end of an end arm 26 is connected to the second rotational mount 24 via the third swinging joint 10. The third swinging joint 10 rotates the end arm 26 around an axis CH3 (FIG. 4). FIG. 4 shows the rotational direction of the end arm 26 by an arrow E.

The second arm 22 is constituted of a front portion 22*a*, a rear portion 22*b*, and the third pivoting joint 15 that connects the front portion 22*a* and the rear portion 22*b*. The third pivoting joint 15 is capable of turning the rear portion 22*b* on the front portion 22*a* around a rotational axis 17 (FIG. 4). FIG. 4 shows the rotational direction of the rear portion 22*b* by an arrow F.

It should be noted that the second rotational joint 14 and the second rotational mount 24 shown in FIG. 3 do not appear in FIG. 4 since they are hidden behind.

As shown in FIG. 4, a rotatable supplemental joint 28 is provided on the other end of the end arm 26. The bending mechanism 30 is attached to the supplemental joint 28. The supplemental joint 28 is mechanically connected to the third swinging joint 10 via a not shown gear mechanism. In this manner, when the end arm 26 is rotated 360° by the third swinging joint 10, the bending mechanism 30 is also rotated 360° by the supplemental joint 28.

With the above constitution, the bending mechanism 30 of the present embodiment can be rotated around the workpiece 4 without interfering with the workpiece 4. In the above description, the supplemental joint 28 is mechanically connected to the third swinging joint 10 via a not shown gear mechanism. However, the supplemental joint 28 may be rotated, for example, by a drive motor, independently of the movement of the third swinging joint 10.

Figure 5:
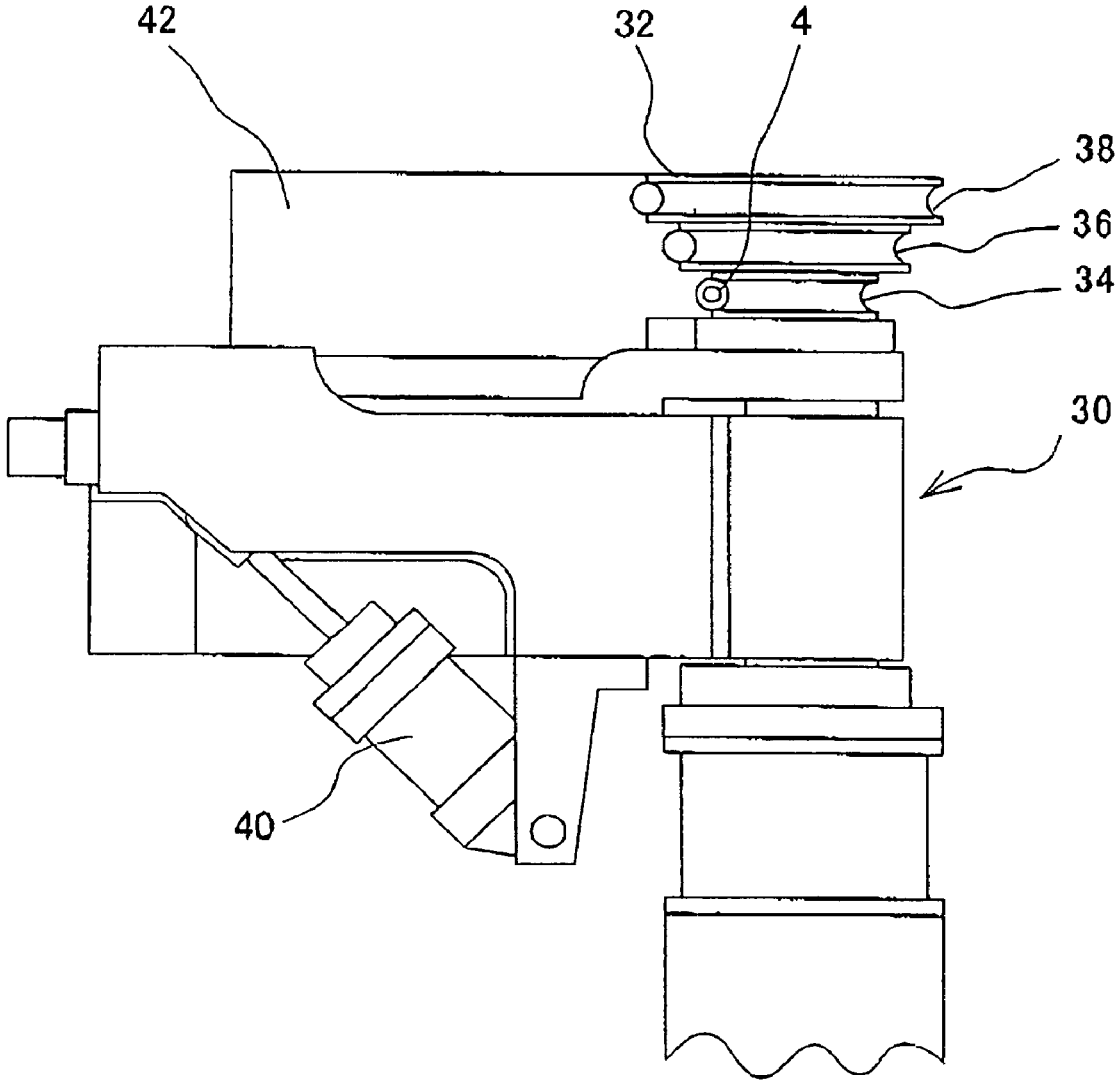
FIG. 5 is an enlarged side view of a bending mechanism of the embodiment.
Figure 6:
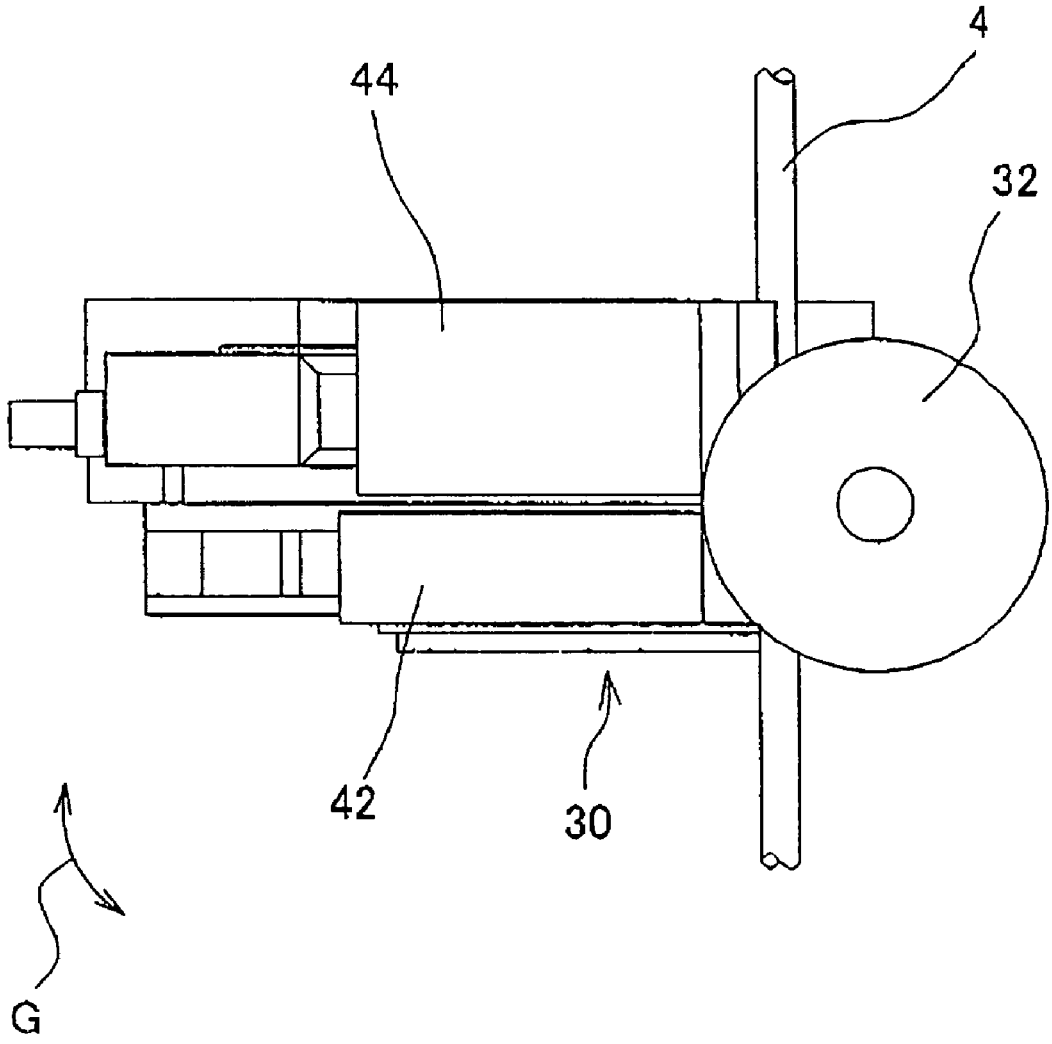
FIG. 6 is an enlarged plan view of a bending mechanism of the embodiment.

As shown in FIGS. 5 and 6, the bending mechanism 30 includes a bending die 32. The bending die 32 is formed of three groove portions 34, 36, and 38 layered in an axial direction of the bending die 32. Each of the three groove portions 34, 36, and 38 corresponds to a different bending radius. A clamping die is also provided which clamps the workpiece 4 together with the bending die 32. The clamping die is driven by a cylinder 40 to move toward the bending die 32. The clamping die 42 rotates around the bending die 32 with the workpiece 4 being clamped therebetween so as to bend the workpiece 4 at a predetermined angle. A pressure die 44 is also provided on the same line with the clamping die 42 and receives a reaction force upon bending. FIG. 6 shows the rotational direction of the clamping die 42 by an arrow G.

A chuck mechanism 46 is disposed on a fixed mount 48 and grips one end of the workpiece 4. The chuck mechanism 46 is designed such that the workpiece 4 gripped by the chuck mechanism 46 is horizontal to the floor, that is, orthogonal to the vertical axis CV1 of the first pivoting joint 12. Also, a delivery mount 50 and a discharge mount 52 are provided on each side of the articulated robot 2.

The articulated robot 2 rotates the first to third swinging joints 6, 8, and 10 and the first to third pivoting joints 12, 14, and 15 so as to control the posture and the position of the bending mechanism 30 as shown in FIGS. 10A to 10B and 11A to 11E.

Figure 10A:
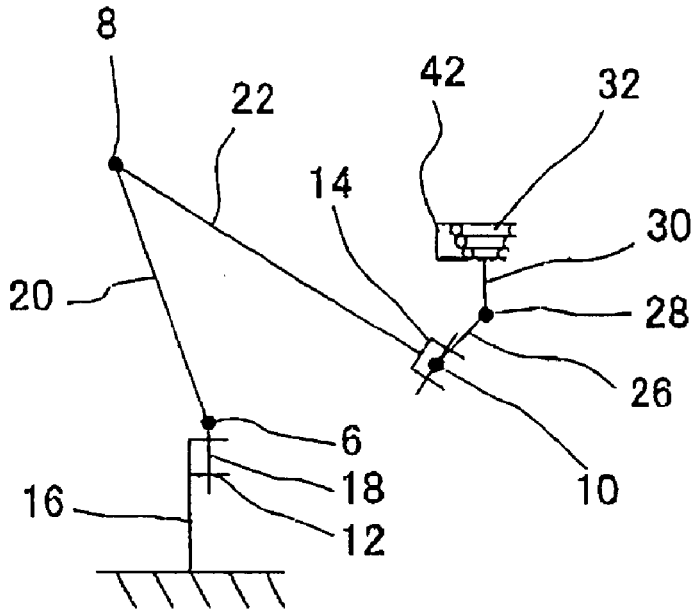
FIGS. 10A and 10B are views illustrating movements of the articulated robot of the embodiment, when viewed in a lateral direction.
Figure 10B:
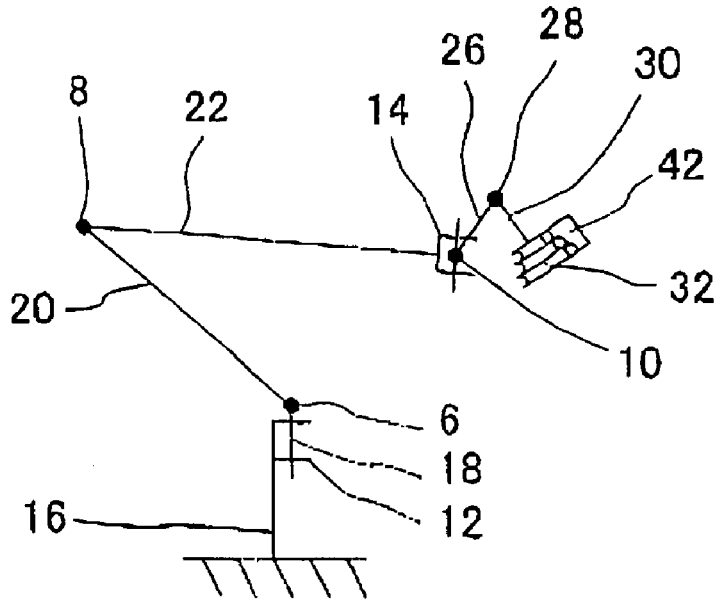

For example, as shown in FIGS. 10A and 10B, the bending mechanism 30 can be moved in such a manner that the bending direction of the workpiece 4 corresponds to the direction of the groove portion 34 (36, 38) of the bending die 32, depending on a target bending direction of the workpiece 4. That is, the posture of the bending device 30 can be changed in accordance with the target bending direction. In the present embodiment, since there is a certain synchronous relationship between the third swinging joint 10 and the supplemental joint 28, the positions of the end arm 26 and the third swinging joint 10 are fixed if the bending direction is defined.

The second swinging joint 8 is positioned on a circular arc, in the center of which is located the first swinging joint 6, and of which radius is equal to the distance between the first swinging joint 6 and the second swinging joint 8. At the same time, the second swinging joint 8 is positioned on a circular arc, in the center of which is located the third swinging joint 10, and of which radius is equal to the distance between the second swinging joint 8 and the third swinging joint 10. Accordingly, the position of the bending die 32 is fixed when the second swinging joint 8 is on the intersection of both the circular arcs. There are cases in which two intersections may exist. In such cases, one of the intersections is selected where the second arm 22 does not interfere with the workpiece 4, and where the free end of the workpiece 4 after bent does not interfere with the second arm 22.

By fixing the positions of the respective first to third swinging joints 6, 8, and 10, the respective angles between the fixed base 16 and the first arm 20, between the first arm 20 and the second arm 22, and the second arm 22 and the end arm 26, are respectively obtained. According to the obtained angles, the first arm 20, the second arm 22, and the end arm 26 are rotated at predetermined angles by the respective first to third swinging joints 6, 8, and 10. In this manner, the groove portion 34 (36, 38) of the bending die 32 is moved to abut the workpiece 4.

Figure 11A:
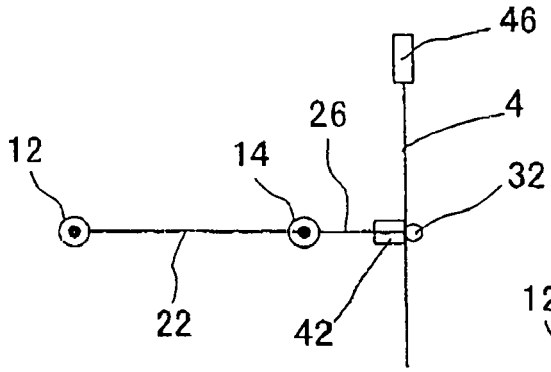
FIGS. 11A to 11E are views illustrating movements of the articulated robot of the embodiment, when viewed from the top.

As shown in FIG. 11A, when the first arm 20, the second arm 22, and the end arm 26 are on a plane that is orthogonal to the workpiece 4, the first to third swinging joints 6, 8, and 10 is rotated to move the bending mechanism 30 around the workpiece 4 so that, as shown in FIGS. 10A and 10B, the bending direction is turned to a desired direction.

Figure 11B:
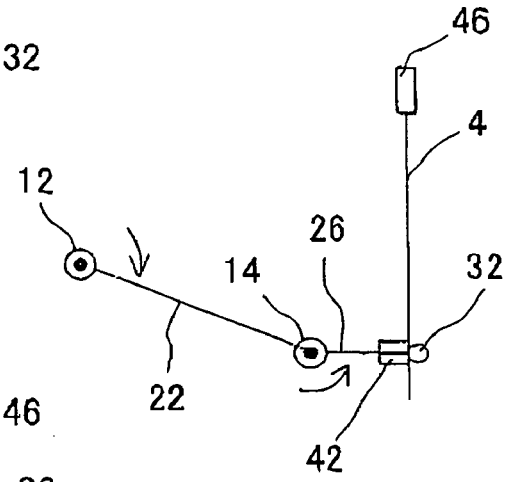

As shown in FIG. 11B, when the bending position is on the side of the workpiece 4 opposite to the chuck mechanism 46, the first pivoting joint 12 is rotated and the second pivoting joint 14 is rotated opposite to the rotational direction of the first pivoting joint 12, so that the axial direction of the end arm 26 is orthogonal to the workpiece 4. Also, the first to third swinging joints 6, 8, and 10 are rotated. As the first pivoting joint 12 is rotated, the bending mechanism 30 is moved away from the workpiece 4. Thus, the second pivoting joint 14 and the first to third swinging joints 6, 8, and 10 are rotated so that the groove portion 34 of the bending die 32 is abutted on the workpiece 4. It goes without saying that the bending form can be changed by having the workpiece 4 abut on the other groove portions 36 and 38.

Figure 11C:
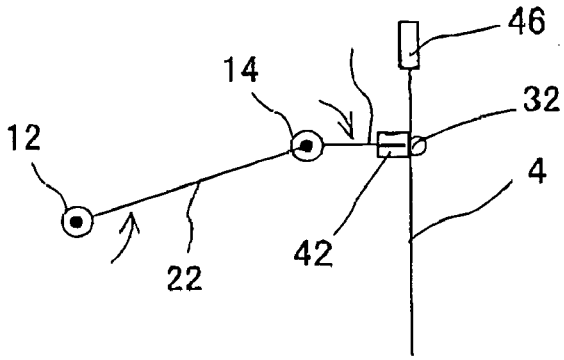

As shown in FIG. 11C, when the bending is performed at a bending position close to the chuck mechanism 46 as well, the first pivoting joint 12 is rotated so as to move the bending mechanism 30 to the bending position in a similar fashion. At that time, the second pivoting joint 14 is rotated opposite to the rotational direction of the first pivoting joint 12 so that the axial direction of the end arm 26 is orthogonal to the workpiece 4. The first to third swinging joints 6, 8, and 10 are also rotated.

When bending is performed at a plurality of positions, the aforementioned operation is repeated from a bending position on the free end side of the workpiece 4 opposite to the side of the chuck mechanism 46, as shown in FIG. 11B, toward a bending position close to the chuck mechanism 46 so that the bending is performed to the workpiece 4 in sequence. The bending mechanism 30 may be rotated around the workpiece 4 with the workpiece 4 being clamped between the bending die 32 and the clamping die 42. Then, the workpiece 4 may be turned to change the bending direction. In this manner, the workpiece 4 that has been bent cannot interfere with the device or the floor.

Figure 7:
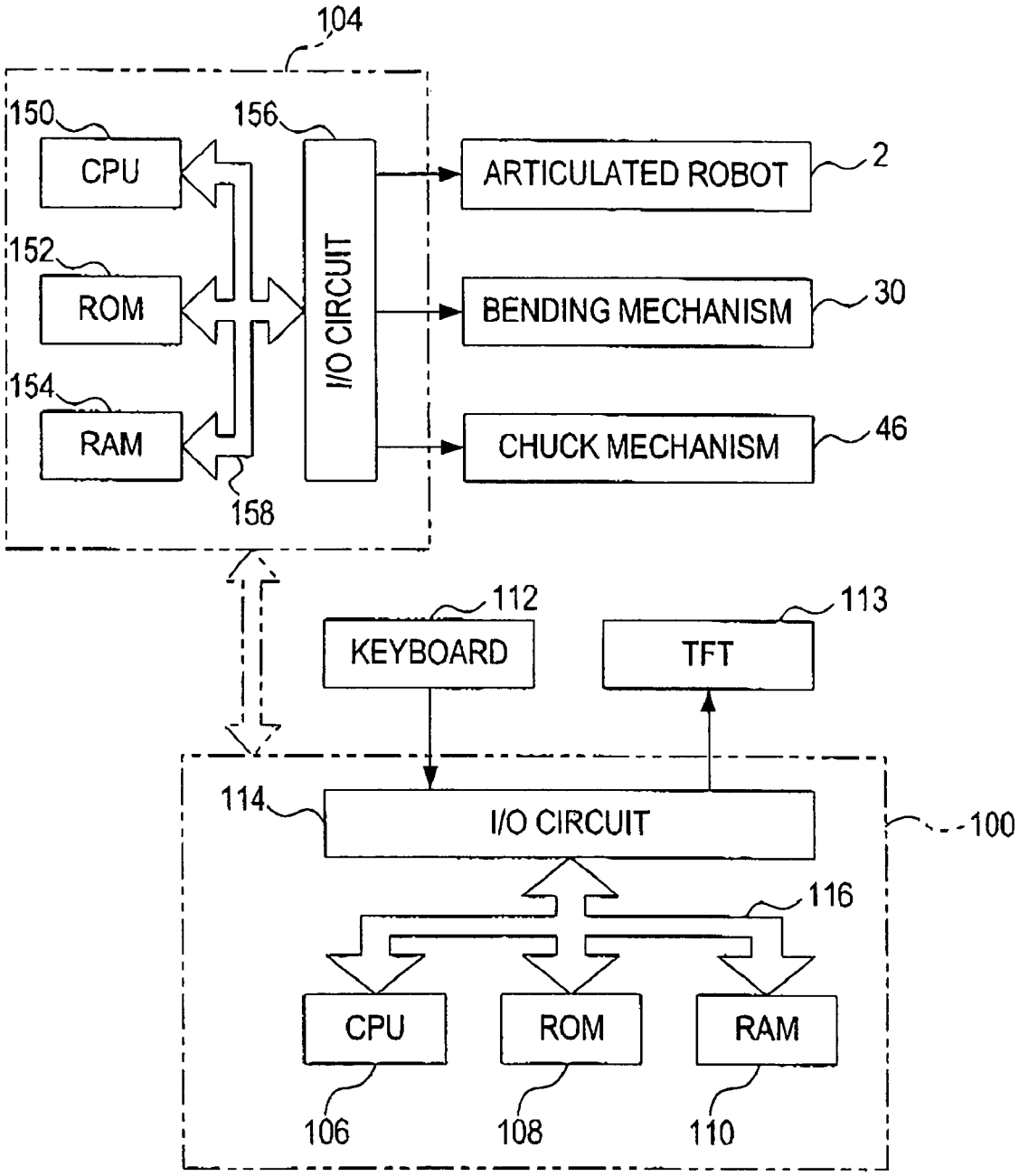
FIG. 7 is a block diagram showing a control system of the bending device according to the embodiment.

Referring to FIG. 7, the bending device is driven and controlled by a host computer 100 and a control unit 104 to bend the workpiece 4. The host computer 100 includes a CPU 106, a ROM 108, and a RAM 110 as main components of a logic operation circuit. The CPU 106, the ROM 108, and the RAM 110 are connected via a common bus 116 to an I/O circuit 114 which controls the input/output of a signal between a keyboard 112 and a TFT display 113.

The data related to the bending, or delivery and discharge of the workpiece 4 is submitted to the host computer 100 from the keyboard 112 operated by an operator. In the host computer 100, a program is generated which is used to operate the articulated robot 2, the bending mechanism 30, and the chuck mechanism 46. The generated program is transmitted from the host computer 100 to the control unit 104.

The control unit 104 is provided with a CPU 150, a ROM 152 and a RAM 154 as main components of a logic operation circuit. The CPU 150, the ROM 152, and the RAM 154 are connected via a common bus 158 to an I/O circuit 156. The articulated robot 2, the bending mechanism 30 and the chuck mechanism 46 are connected to the I/O circuit 156.

Figure 8:
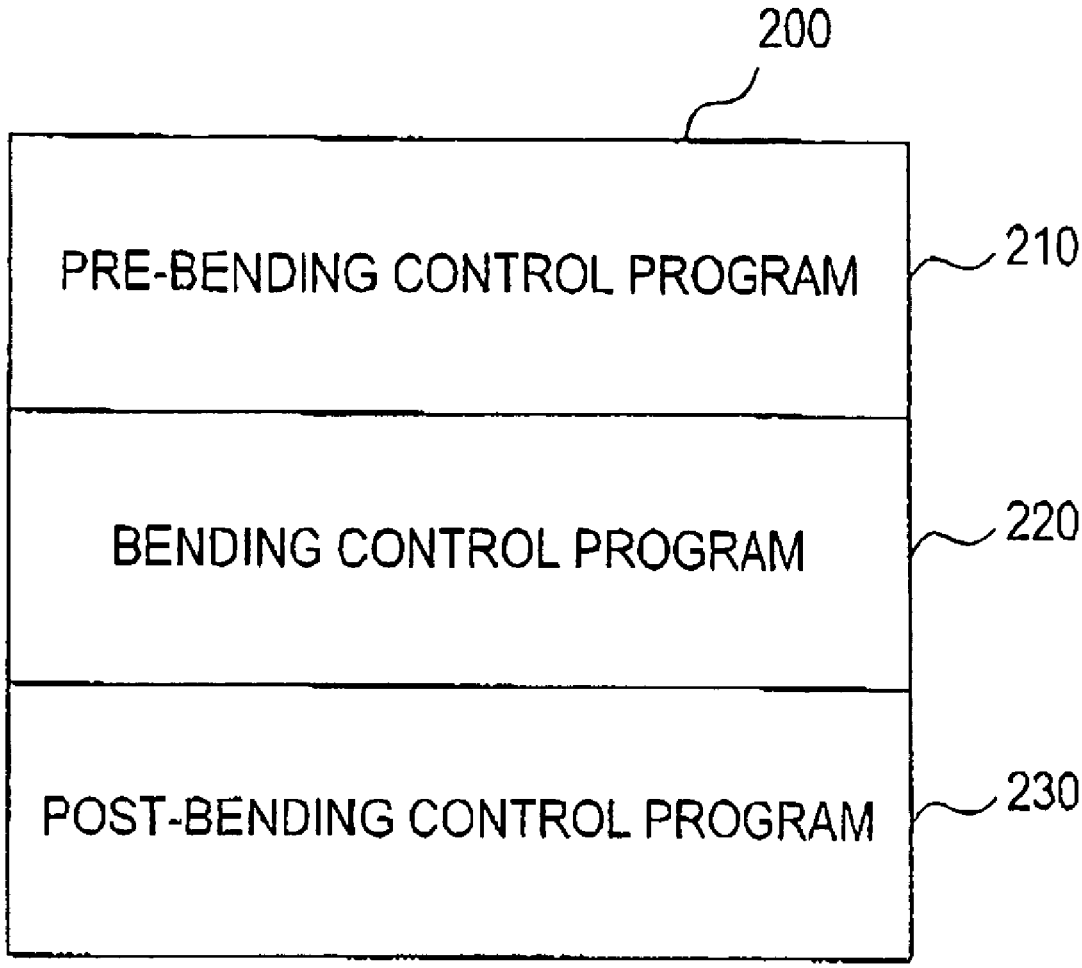
FIG. 8 is a schematic diagram showing a program structure of the bending device according to the embodiment.

Referring to FIG. 8, a software 200 stored in the control unit 104 includes a pre-bending control program 210, a bending control program 220, and a post-bending control program 230. The pre-bending control program allows a user to arbitrarily perform operation necessary to the workpiece 4 before bending. The bending control program 220 is used to control the bending. The post-bending control program 230 allows a user to arbitrarily perform operation necessary to the workpiece 4 after the bending.

Setting of the pre-bending control program 210 and the post-bending control program 230 is performed by a user. However, it is preferable that the programs are automatically generated by teaching of the necessary operation. In the host computer 100, required settings and modifications are arbitrarily made to the pre-bending control program 210, the bending control program 220, and the post-bending control program 230 so that a series of operation from the start to the end performed to the workpiece 4 is smoothly carried out. These programs are transmitted to the control unit 104 as one unified program.

Figure 9:
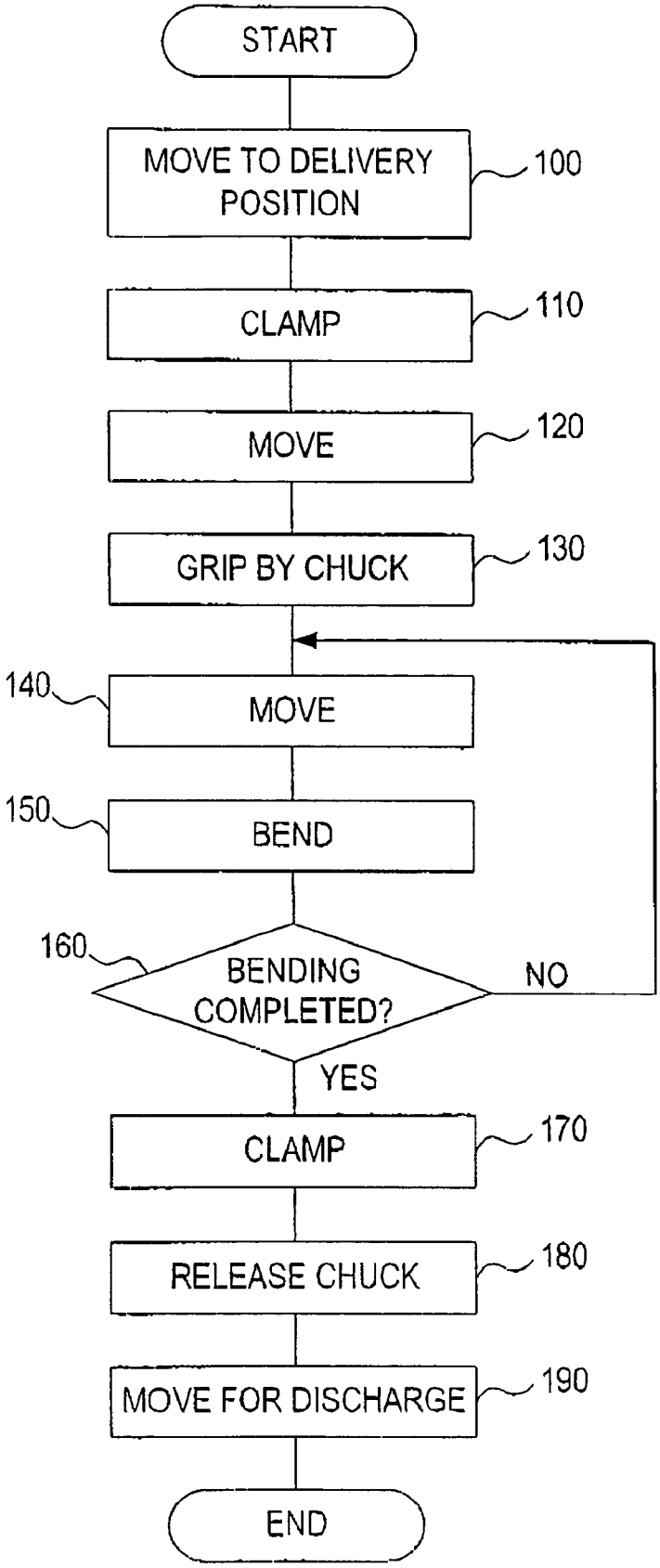
FIG. 9 is a flowchart illustrating an example of a bending control process performed by a control unit of the embodiment.

Hereafter, the operation of the bending device of the aforementioned embodiment will be described by way of a flowchart shown in FIG. 9, together with a bending control process performed in the control unit 104.

Figure 11D:
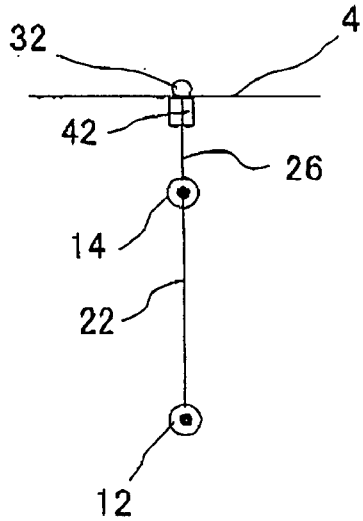

Firstly, the workpiece 4, which is cut to have a predetermined length in advance, is conveyed onto the delivery mount 50. Then, as shown in FIG. 11D, the first pivoting joint 12 of the articulated robot 2 is driven such that the articulated robot 2 faces the workpiece 4 on the delivery mount 50. Also, the first to third swinging joints 6, 8, and 10 of the articulated robot 2 are driven to move the bending mechanism 30, so that the workpiece 4 is abut onto the groove portion 34 of the bending die 32 (Step 100).

Next, the clamping die 42 is moved so that the workpiece 4 is clamped by the bending mechanism 30 (Step 100). After that, the articulated robot 2 is controlled to drive the respective first to third swinging joints 6, 8, and 10 and first to third pivoting joints 12, 14, and 15, so that, as shown in FIG. 11A, the workpiece 4 is moved toward the chuck mechanism 46 in such a manner that one end of the workpiece 4 can be gripped by the chuck mechanism 46 (Step 120).

When the workpiece 4 on the delivery mount 50 has reached the chuck mechanism 46, the chuck mechanism 46 is controlled to grip the end of the workpiece 4 (Step 130)

Now, the articulated robot 2 is controlled so that the bending mechanism 30 is moved to a bending position of the workpiece 4 (Step 140). When there are a plurality of bending positions, the bending is started from the free end of the workpiece 4 opposite to the side of the chuck mechanism 46. After the bending mechanism 30 is moved to a desired position, the clamping die 42 and the pressure die 44 are driven to abut on the workpiece 4. The clamping die 42 is rotated around the pressure die 44 by a predetermined bending angle (Step 150).

After the bending, the clamping die 42 and the pressure die 44 are released. When performing the next bending (Step 160), Steps 140 and 150 are repeated. That is, the articulated robot 2 is controlled to move the bending mechanism 30 to the next bending position to bend to the workpiece 4 by the bending mechanism 30.

When moving the bending mechanism 30, the movement of the respective joints is controlled in such a manner that the bending mechanism 30 moves linearly along the workpiece 4. That is, the end of an arm is controlled to make a linear movement within a rotational range of the arm.

After all the bending is completed (Step 160), the articulated robot 2 is controlled to move the bending mechanism 30 to a position where the workpiece 4 after bent is balanced. The clamping die 42 of the bending mechanism 30 is driven so that the workpiece 4 is clamped between the clamping die 42 and the bending die 32 (Step 170).

Figure 11E:
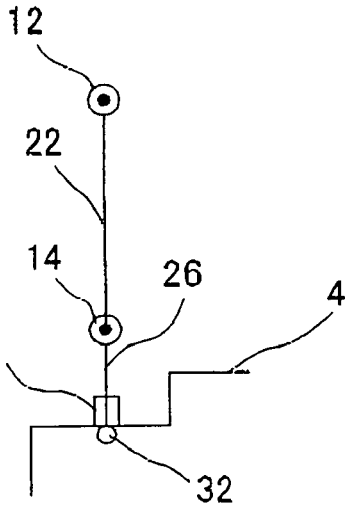

After the clamping of the workpiece 4, the chuck mechanism 46 is controlled to release the workpiece 4 (Step 180). The articulated robot 2 is controlled to move the bending mechanism 30 as shown in FIG. 11E so as to move the workpiece 4 onto the discharge mount 52. Clamping of the workpiece 4 by the bending mechanism 30 is released so that the workpiece 4 is placed on the discharge mount 52 (Step 190).

As above, the workpiece 4 is gripped by the fixed chuck mechanism 46 while the articulated robot 2 moves the bending mechanism 30 to bend the workpiece 4. Thus, the bending device of the present embodiment can be small in size and have a relatively small installation space. Furthermore, by controlling the articulated robot 2 and the chuck mechanism 46, the delivery and the discharge of the workpiece 4 can be accomplished.

It should be noted that, in FIGS. 11A to 11E, only the overlapping portion of the first arm 20 and the second arm 22 is shown as the reference number 22 for the sake of simplification. Also, the second rotational mount 24 is omitted.

The present invention is not limited to the above embodiment, and other modifications and variations are possible within the scope of the present invention.

For instance, in the above embodiment, the chuck mechanism 46 is fixed. However, the chuck mechanism 46 may be movable. Or else, the articulated robot 2 may be designed to be movable. Both the chuck mechanism 46 and the articulated robot 2 may be movable. In any case, as long as the chuck mechanism 46 and the articulated robot 2 can be moved relative to each other, the reach of the robot arm can be extended and the restrictions concerning the bending position of the workpiece can be eased.

Figure 12:
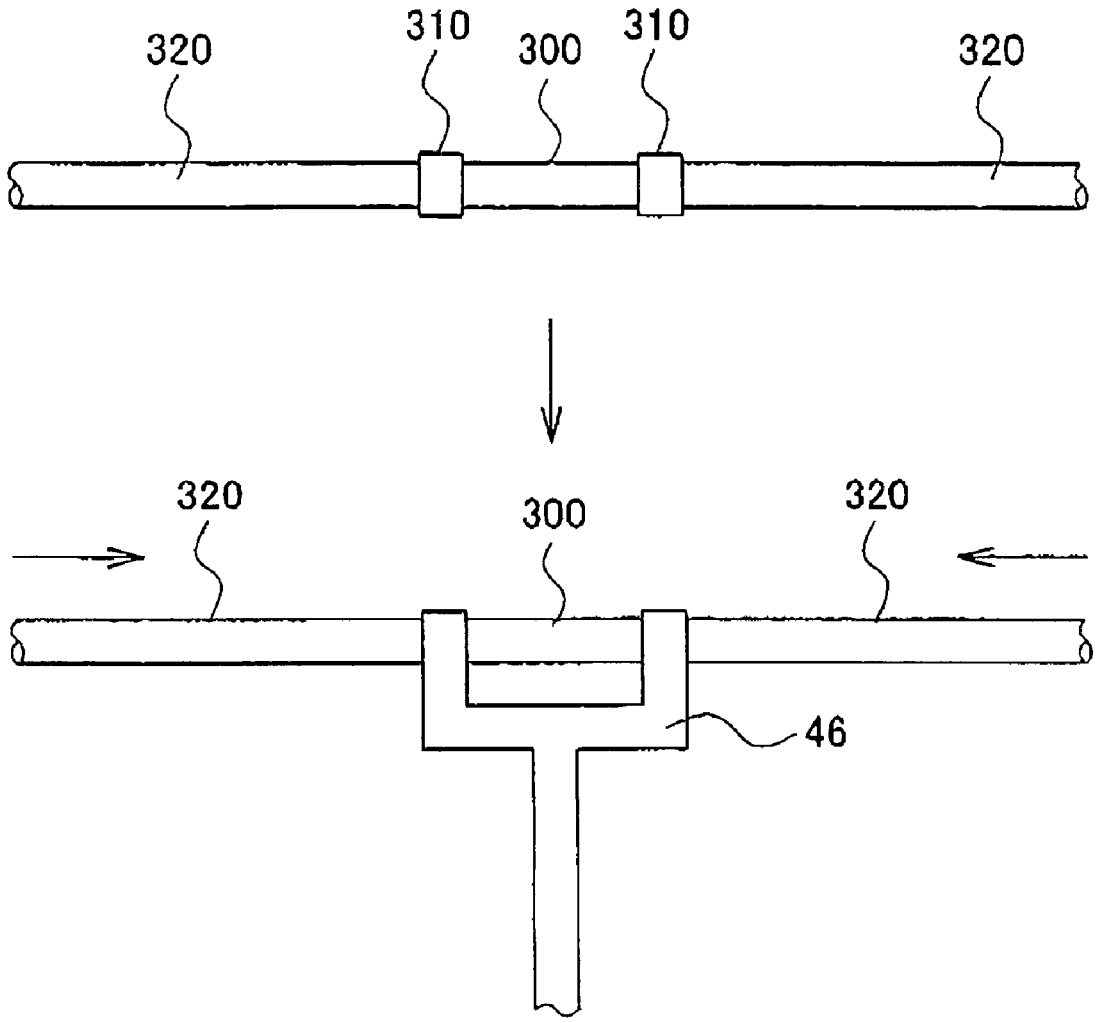
FIG. 12 is a schematic view illustrating a workpiece, clamped at the middle section and bent from both sides.

Now, the present invention may be applied to a case in which, as shown in FIG. 12, bending is performed to a rubber hose 300 having a longitudinal metal pipe 320 on each end via a caulking fitting 310. Conventionally, two metal pipes are attached to a rubber hose after they are respectively bent. In this manner, however, it is difficult to adjust the attaching direction (orientation) of the two pipes.

In the present invention, each pipe 320 to be bent is in advance fixed to the rubber hose 300 using the caulking fitting 310. While the portions of the caulking fittings 310 are gripped by the chuck mechanism 46, two metal pipes 320 are bent toward the portions (inner side) gripped by the chuck mechanism 46 sequentially from the outer portions. In this case, after all the bending is performed to one of the pipes 320, the bending mechanism 30 is turn around so as to bend the other of the pipes 320. In this manner, without the aforementioned problem, it is possible to successfully obtain the two pipes respectively bent to a predetermined direction and connected by an intermediate pipe.

What is claimed is:

1. A bending device comprising:

a chuck mechanism that grips a longitudinal workpiece;

a bending mechanism that clamps the workpiece with a bending die and a clamping die capable of moving around the bending die, and that bends the workpiece by rotation of the clamping die;

an articulated robot that is capable of pivoting and provided with a moving mechanism at an end, the articulated robot including:

a first rotational mount rotatably attached to a base, a first arm rotatably connected to the first rotational mount at one end via a first swinging joint, a second arm connected to the other end of the first arm at one end via a second swinging joint, a second rotational mount rotatably connected to the other end of the second arm via a first pivoting joint, an end arm attached to the second rotational mount at one end via a third swinging joint, and a supplemental joint that is attached to the other end of the end arm and rotates the end arm to rotate the bending mechanism; and a control unit that controls the movement of the articulated robot and moves the bending mechanism along the workpiece.

2. The bending device set forth in claim 1, wherein the second arm has a rotational axis and is capable of making turning operation.

3. The bending device set forth in claim 1, wherein the chuck mechanism is fixed so as not to be moved.

4. The bending device set forth in claim 1, wherein the chuck mechanism and the articulated robot can move relative to each other.

5. The bending device set forth in claim 1, wherein the control unit includes a bending controller that moves the bending mechanism by the articulated robot to perform bending to the workpiece at a plurality of positions.

6. The bending device set forth in claim 5, wherein the control unit includes a delivery control unit that clamps the workpiece between the bending die and the clamping die, and moves the bending mechanism by the articulated robot so as to make the chuck mechanism grip the workpiece.

7. The bending device set forth in claim 5, wherein the control unit includes a discharge control unit that makes the chuck mechanism release the workpiece. with the bending die and the clamping die still clamping the workpiece, after the bending, and moves the bending mechanism by the articulated robot so as to discharge the workpiece.

* * * * *